United States Patent [19]

Asphahani et al.

[11] 4,171,217

[45] Oct. 16, 1979

[54] CORROSION-RESISTANT NICKEL ALLOY

[75] Inventors: Aziz I. Asphahani; F. Galen Hodge; Robert B. Leonard; Patrick D. Schuur, all of Kokomo, Ind.

[73] Assignee: Cabot Corporation, Kokomo, Ind.

[21] Appl. No.: 879,561

[22] Filed: Feb. 21, 1978

[51] Int. Cl.[2] ..... C22C 19/05

[52] U.S. Cl. ..... 75/122; 75/134 F; 75/171; 148/11.5 N; 148/12.7 N; 148/32

[58] Field of Search ..... 75/171, 170, 122, 134 F; 148/11.5 N, 32, 32.5, 12.7 N

[56] References Cited

U.S. PATENT DOCUMENTS 3,203,792 8/1965 Scheil et al. ..... 75/171

*Primary Examiner*—R. Dean

*Attorney, Agent, or Firm*—Joseph J. Phillips; Jack Schuman

[57] ABSTRACT

A nickel-base alloy that is corrosion resistant to hydrogen, sulfide and chloride stress cracking is provided consisting essentially of about 17 to 23% chromium, 8 to 10% molybdenum, 15 to 22% iron, limited contents of cobalt, silicon and manganese, 0.030% maximum carbon and the balance nickel and incidental impurities. The alloy is eminently suited for use as components in so-called "sour-gas" well operations.

8 Claims, No Drawings

CORROSION-RESISTANT NICKEL ALLOY

This invention relates to a nickel-base alloy, and, more particularly, to an improved nickel-base alloy resistant to hydrogen cracking at room temperature and to sulfide and chloride stress cracking at temperatures about 200° C.

U.S. Pat. No. 2,703,277, Spendelow et al., Mar. 1, 1955, discloses a superalloy widely known in the art as HASTELLOY® alloy X, as described in Table I. HASTELLOY is a registered trademark of Cabot Corporation. The alloy, hereinafter referred to as "alloy X", is probably the best known and most used superalloy for more than 20 years. Alloy X is the subject of more than one hundred private and industrial specifications including, principally:

| | | |
|---|---|---|
| ASTM | B435-71 | Sheet and Plate |
| ASME | SB 435 | Sheet and Plate |
| ASTM | B622-77 | Seamless Pipe and Tube |
| AWS | A5.14-76 (ERNiCrMo-2) | Welding Rods and Electrodes |
| SAE | AMS 5536G | Sheet, Plate and Strip |
| SAE | AMS 5754F | Bars, Forgings and Rings |

All of these specifications, except for minor variations, describe an alloy for use especially in high temperature oxidation conditions up to 1200° C., with a typical composition, in weight percent, of about 22% chromium, about 18% iron, about 9% molybdenum, less than 2.5% cobalt, less than 1% each of tungsten, manganese and silicon, about 0.1% carbon and balance nickel.

Alloy X has been tested for possible use as components in "sour gas" well operations. Failures in "sour gas" well environments have resulted in a search for new or improved corrosion-resistant alloys. "Sour gas" well operations are generally under extremely severe conditions of high hydrogen sulfide and chloride atmospheres at temperatures up to about 200° to 250° C.

To overcome the "sour gas" corrosion problems, much experimentation with many corrosion-resistant alloys has been required. No perfect solution has been possible because some alloys that are resistant to hydrogen cracking are not resistant to sulfide and chloride attack, and, correspondingly, some alloys resistant to sulfide and chloride attack are not resistant to hydrogen cracking. For this reason, all known corrosion-resistant alloys, and even some high temperature alloys (including alloy X), were tested for possible use in "sour gas" operations. None have been entirely satisfactory for a variety of reasons.

It is the principal object of this invention to provide a new corrosion-resistant alloy that is resistant to hydrogen cracking and also to sulfide and chloride attack. Another object of this invention is to provide a new corrosion-resistant alloy for use as components in "sour gas" well operations. Other objects and advantages may be apparent from the disclosures herein.

The objects are obtained by the provision of an alloy as described in Table I. Table I also discloses the composition of alloy X, and alloy X' that was used in testing programs.

As stated above, the commercial alloy X was tested and found to be unsatisfactory. As part of the experimental program, a new alloy (described as alloy 8700 in Table I) was conceived and tested. Alloy 8700 is somewhat similar to alloy X. It appears that the control of carbon content is very critical in the alloy of this invention.

The high-temperature strength properties of alloy X are generally attributed to the formation of carbides in the alloy. Thus, carbon is an essential element in alloy X and is required at levels higher than 0.05%. A carbon content of not less than about 0.10% continues to be the nominal aim point. For cast versions of the alloy, higher contents of carbon, up to about 0.2%, are generally preferred.

The carbon content in the alloy of this invention must not exceed 0.03%, and, preferably, may be less than about 0.02%.

EXAMPLE I

Specimens of alloy X' were tested for resistance to hydrogen cracking in NACE solution (5% NaCl+0.5% $CH_3COOH+H_2S$) at room temperature. The specimens were tested in the as-cold-worked 60% condition and the as-cold-worked 60% plus heat-treatments condition at stress levels of 75% and 100% yield. Each test was run over 1000 hours with no failures. The data are presented in Table II.

EXAMPLE II

Specimens of alloy X' were tested in the as-cold-worked 60% condition plus 200 hours at 200° C. at stress level of 100% yield. One specimen was tested in an autoclave in the NACE solution at 200° C. to determine resistance to sulfide stress cracking. The specimen cracked and there was concurrent corrosion attack.

Another specimen was tested in a 45% solution of $MgCl_2$ at 159° C. to determine resistance to chloride stress cracking. There was cracking in this specimen also. Data are shown in Table III.

EXAMPLE III

Specimens of alloy X' and alloy 8700, both as described in Table I, were tested to obtain a comparison under identical conditions. Specimens of both alloys were tested in the as-cold-worked 60% condition plus 200 hours at 200° C. at stress level about equal to yield. The specimens were tested to determine resistance to hydrogen cracking essentially as described in EXAMPLE I (Table II) and to sulfide and chloride stress cracking essentially as described in EXAMPLE II (Table III). Results of the tests are presented in Table IV.

The data in Table IV, resulting from EXAMPLE III, clearly show the superiority of alloy 8700 over the prior art alloy X'. The most critical difference between alloy 8700 and alloy X' resides in the carbon content. The tests show that alloy 8700, with 0.18% carbon, did not fail or corrode while alloy X', with about 0.10% carbon, not only failed but also was subject to sulfide corrosion attack. Furthermore, lowering the carbon content did not affect the alloy's resistance to hydrogen cracking at room temperature.

Table I

| ALLOY COMPOSITIONS in weight percent | ALLOY X | | ALLOY OF THIS INVENTION | | | |
|---|---|---|---|---|---|---|
| | RANGE | ALLOY X' | BROAD RANGE | PREFERRED RANGE | ALLOY 8700 | TYPICAL ALLOY |
| Cobalt | 0.5 to 2.5 | 1.26 | 0 to 5.0 | 0.5 to 5.0 | 1.74 | about 2 |
| Chromium | 20.50 to 23.00 | 21.36 | 17 to 23 | 17 to 23 | 21.84 | about 22 |
| Molybdenum | 8.0 to 10.0 | 8.94 | 8 to 10 | 8 to 10 | 8.74 | about 9 |
| Tungsten | up to 1.0 | .56 | 0 to 3.0 | .2 to 3.0 | .61 | about 1 |
| Iron | 17.0 to 20.0 | 18.91 | 15 to 22 | 17 to 22 | 19.63 | about 20.0 |
| Silicon | 1.0 max | .33 | 1 max | 1 max | .32 | 1 max |
| Manganese | 1.0 max | .53 | 1 max | 1 max | .62 | 1.0 max |
| Phosphorus | 0.040 max | .021 | 0.040 max | 0.040 max | .015 | 0.03 max |
| Sulphur | 0.030 max | .022 | 0.030 max | 0.030 max | .004 | 0.02 max |
| Carbon | 0.05 to 0.15 | .11 | 0.030 max | 0.030 max | 0.018 | 0.02 max |
| Nickel | Bal | Bal | Bal | Bal | Bal | Bal |

TABLE II

HYDROGEN CRACKING TEST
ALLOY X' (.1% C)
NACE Solution (5% NaCl + .5% $CH_3COOH$ + $H_2S$)
Tested at Room Temperature

| CONDITION | STRESS LEVEL 75% Yield | 100% Yield |
|---|---|---|
| (1) 60% cold-worked (C.W.) | N.F. | N.F. |
| (2) 60% C.W. + 200 hrs/200° C. | N.F. | N.F. |
| (3) 60% C.W. + 100 hrs/500° C. | N.F. | N.F. |

N.F.: No Failure in more than 100 hours

TABLE III

SULFIDE AND CHLORIDE STRESS CRACKING TESTS
ALLOY X' (.1% C)
60% C.W. + 200 Hours/200° C.

| Stress Level | Sulfide Stress Cracking NACE, 200° C. Autoclave - 300 Hours | Chloride Stress Cracking 45% $MgCl_2$,159° C. 300 Hours |
|---|---|---|
| >100% Yield | Failure* | Cracking |

*Failure: Stress cracking and corrosive attack

What is claimed is:

1. An alloy resistant to hydrogen cracking and sulfide and chloride stress cracking consisting, essentially, of, in weight percent, up to 5% cobalt, 17 to 23% chromium, 8 to 10% molybdenum, up to 3% tungsten, 15 to 22% iron, not over 1% silicon, not over 1% manganese, 0.040% maximum phosphorus, 0.030% maximum sulfur, 0.030% maximum carbon and the balance nickel and incidental impurities.

2. The alloy of claim 1 wherein the carbon content is not over about 0.020%.

3. The alloy of claim 1 wherein cobalt is 0.5 to 5.0%, tungsten is 0.2 to 3.0% and iron is 17 to 22%.

4. The alloy of claim 1 wherein the alloy has been cold worked up to 70% reduction.

5. An article for use as components in sour gas well operations composed of the alloy of claim 1.

6. The alloy of claim 1 wherein the silicon content is about 0.32%.

7. The alloy of claim 1 wherein the silicon content is at least 0.32%.

8. The alloy of claim 1 wherein the silicon content is present in an amount up to 0.32%.

* * * * *

Table IV

60% COLD-WORKED + 200 HOURS/200° C.

| ALLOY | HYDROGEN CRACKING NACE, ROOM TEMPERATURE 1000 HOURS | Stress Level ≧ Yield SULFIDE STRESS CRACKING NACE 200° C. (AUTOCLAVE) 300 HOURS | CHLORIDE STRESS CRACKING 45% $MgCl_2$, 159° C. 300 HOURS |
|---|---|---|---|
| Alloy X' (.1% C) | No Failure | Failure* | Cracking |
| Alloy 8700 (.018% C) | No Failure | No Failure | No Failure |

*Failure: Stress cracking and corrosive attack

UNITED STATES PATENT OFFICE

CERTIFICATE OF CORRECTION

Patent No. 4,171,217 Dated October 16, 1979

Inventor(s) Aziz I. Asphahani, F. Galen Hodge, Robert B. Leonard, Patrick D. Schuur It is certified that error appears in the above-identified patent and that said Letters Patent are hereby corrected as shown below:

In the specification, column 2, line 63 "0.18% carbon" should read -- 0.018% carbon --

Signed and Sealed this

*Thirteenth* Day of *May 1980*

[SEAL]

*Attest:*

SIDNEY A. DIAMOND

*Attesting Officer*

*Commissioner of Patents and Trademarks*